US006346848B1

(12) United States Patent
Shkap

(10) Patent No.: US 6,346,848 B1
(45) Date of Patent: Feb. 12, 2002

(54) APPARATUS AND METHOD FOR GENERATING CURRENT LINEARLY DEPENDENT ON TEMPERATURE

(75) Inventor: Daniel Shkap, Cambridge, MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/606,832

(22) Filed: Jun. 29, 2000

(51) Int. Cl.[7] ..... G05F 1/10; G05F 3/02

(52) U.S. Cl. ..... 327/538; 327/539; 327/512; 327/542; 323/312; 323/315

(58) Field of Search ..... 327/538, 539, 327/542, 543, 512; 323/312, 315

(56) References Cited

U.S. PATENT DOCUMENTS 5,481,180 A 1/1996 Ryat ..... 323/315
5,512,817 A * 4/1996 Nagaraj ..... 327/539
5,619,163 A 4/1997 Koo ..... 327/539
5,631,600 A * 5/1997 Akioka et al. ..... 327/538
5,672,961 A * 9/1997 Etrikin et al. ..... 323/315
5,774,013 A * 6/1998 Groe ..... 327/539
6,016,051 A * 1/2000 Can ..... 323/315
6,137,324 A * 10/2000 Chung ..... 327/539
6,150,872 A * 11/2000 McNeill et al. ..... 327/539
6,166,587 A * 12/2000 Burzio ..... 327/538
6,184,723 B1 * 2/2001 Frechette et al. ..... 327/538

* cited by examiner

*Primary Examiner*—Terry D. Cunningham
*Assistant Examiner*—Long Nguyen
(74) *Attorney, Agent, or Firm*—Ratner & Prestia; Joseph P. Abate, Esq.

(57) ABSTRACT

A multipurpose current source for generating a current with linear positive temperature dependence at a predetermined slope. This multipurpose current source includes a proportional to absolute temperature (PTAT) current source, a constant current generation circuit coupled to the PTAT current source circuit and a circuit coupled to the PTAT current source circuit and the constant current generation circuit by which a temperature dependent current developed by the PTAT current source and a constant current independent of temperature developed by the constant current generation circuit are combined The linear positive temperature dependent current is generated by subtracting to develop a temperature dependent current by reducing the temperature dependent current developed by the PTAT current source by the constant current independent of temperature developed by the constant current generation circuit.

12 Claims, 3 Drawing Sheets

APPARATUS AND METHOD FOR GENERATING CURRENT LINEARLY DEPENDENT ON TEMPERATURE

TECHNICAL FIELD

This invention relates, in general, to current source circuits and, in particular, to current source circuits that generate current with linear positive temperature dependence.

BACKGROUND OF THE INVENTION

In some electronic circuits, it is desirable or necessary to have a current source that is regulated to compensate for changes that occur within the circuit due to temperature. An example of such a current source is called a proportional to absolute temperature (PTAT) current source that is used as a tail current in a differential bipolar amplifier, as illustrated in FIG. 1, to maintain a constant gain in the presence of temperature variations.

However, a PTAT current source may be inadequate in amplifiers that transfer power to a load, which is determined by the value of the bias current. The reason for this is that at cold temperatures, the PTAT drops to a lower value compared to its value at room temperature and, therefore, the power that is intended to be transferred will not develop across the load due to the diminished bias current at cold temperatures.

Conceivably, a gain chain, similar to that of a communications system, may have the last amplifier biased at a constant current, so as to deliver the proper power to a load, while the other gain components in the chain will compensate for the gain variations in the last amplifier and for the self-gain variations. In such a case, a current source having a slope that is different from that of a PTAT current source is required.

FIG. 2 depicts typical PTAT current slopes. Three values are provided to show that PTAT current changes linearly with respect to temperature and is always 0 at 0 K. However, this temperature dependency limits the application of PTAT currents. Thus, it is desirable to have a current source that provides the same current value at room temperature (i.e., examining line B), but has a slope other than the PTAT slope.

Other applications may be in circuits where an electrical parameter is a function of temperature and with a current that varies with an arbitrary slope, these electrical variations are canceled. A particular example would be a MOS transistor, biased in the linear region to manifest a resistance. This resistance is, in part, a function of temperature. By adjusting the gate voltage appropriately, the variations in resistance due to temperature can be cancelled. The gate voltage can be generated by first using a current source linearly dependent on temperature at the appropriate slope and then converting this current to a voltage (e.g., by impressing it on a resistor) and applying the voltage to the gate of the MOS device.

SUMMARY OF THE INVENTION

It is an objective of the present invention to provide a new and improved current source that is linearly dependent on temperature.

It is another objective of the present invention to provide a current source that has a predetermined current versus temperature slope.

An apparatus for generating a current linearly dependent on temperature, constructed in accordance with the present invention, includes a proportional to absolute temperature current source for generating a proportional to absolute temperature current and a constant current generation circuit responsive to the proportional to absolute temperature current for generating a constant current independent of temperature. An apparatus for generating a current linearly dependent on temperature, constructed in accordance with the present invention, also includes current combining means coupled to the proportional to absolute temperature current source and the constant current generation circuit for combining the proportional to absolute current and the constant current independent of temperature to generate a linearly temperature dependent current with a predetermined slope by one of reducing the proportional to absolute temperature current by the constant current independent of temperature and increasing the proportional to absolute temperature current by the constant current independent of temperature.

A method for generating a current linearly dependent on temperature, according to the present invention, includes the steps of generating a proportional to absolute temperature current and generating a constant current independent of temperature. The method further includes combining the proportional to absolute temperature current and the constant current independent of temperature to generate a linearly temperature dependant current with a predetermined slope. The linearly temperature dependent current is generated by one of reducing the proportional to absolute temperature current by the current independent of temperature and increasing the proportional to absolute temperature current by the constant current independent of temperature.

The details of the preferred embodiment of the present invention are set forth in the accompanying drawings and the description below. Once the details of the invention are known, other additional innovations and changes will become obvious to one skilled in the art.

DESCRIPTION OF THE INVENTION

Figure 1:
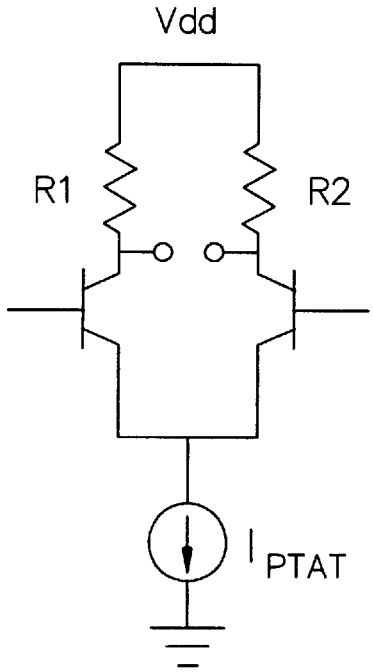
FIG. 1 shows a typical amplifier with a proportional to absolute temperature (PTAT) current source providing bias current.
Figure 2:
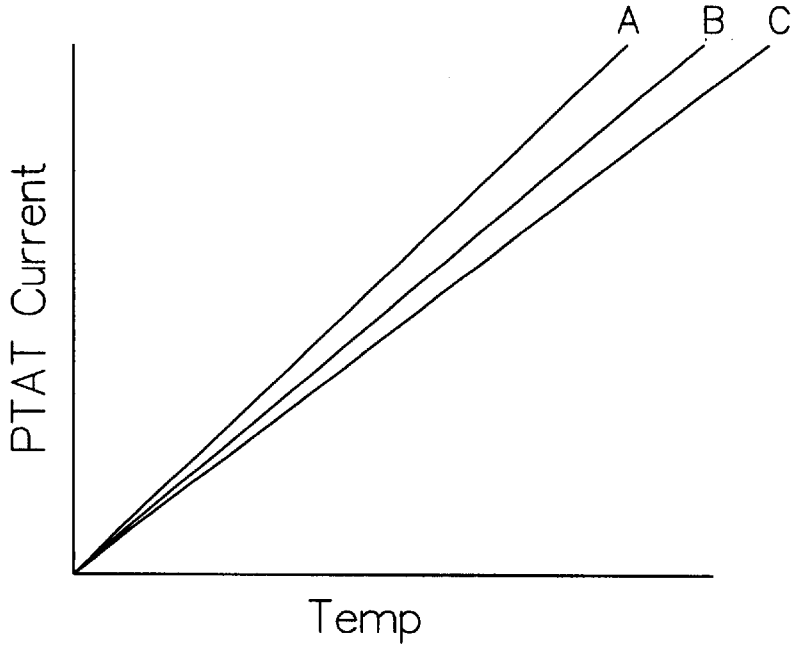
FIG. 2 depicts typical PTAT current slopes.
Figure 3:
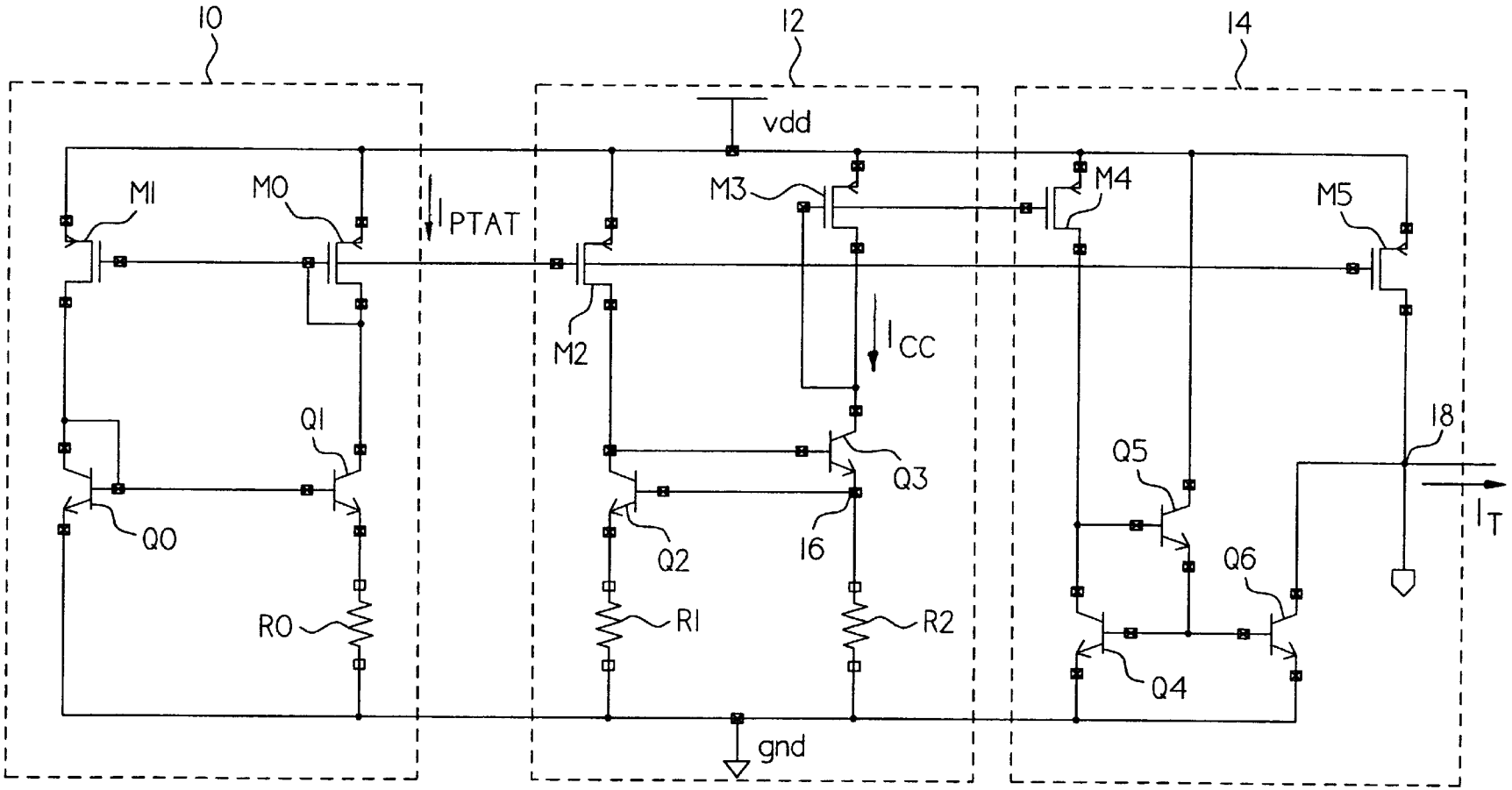
FIG. 3 is a circuit diagram of a preferred embodiment of the current source generating a current linearly dependent on temperature constructed in accordance with the present invention.

Referring to FIG. 3, an apparatus for generating a current linearly dependent on temperature, constructed in accordance with the present invention, includes a proportional to absolute temperature current source 10 for generating a proportional to absolute temperature current $I_{PTAT}$. The proportional to absolute temperature current source 10 is of conventional construction and operation. For the embodiment of the invention illustrated by FIG. 3, the proportional to absolute temperature current source 10 includes bipolar devices Q0 and Q1, CMOS devices M0 and M1, and a resistor R0.

The apparatus for generating a current linearly dependent on temperature, constructed in accordance with the present invention, further includes a constant current generation circuit 12, responsive to the proportional to absolute temperature current $I_{PTAT}$, for generating a constant current independent of temperature $I_{CC}$. The constant current generation is of conventional construction and operation. For the embodiment of the invention illustrated by FIG. 3, the constant current generation circuit 12 includes bipolar devices Q2 and Q3, CMOS devices M2 and M3, and resistors R1 and R2. The proportional to absolute temperature current $I_{PTAT}$ developed by proportional to absolute temperature current source 10 is mirrored by CMOS device M1 of constant current generation circuit 12 to bipolar device Q2 and is conducted through resistor R1. The value of resistor R1 is chosen such that the voltage at the base of bipolar device Q2 is a bandgap voltage. The bandgap voltage generates the constant current independent of temperature $I_{CC}$ as the bandgap voltage is applied across resistor R2. Bipolar device Q3 acts as a current buffer to the constant current independent of temperature $I_{CC}$ as this current is conducted through resistor 2 by providing a low impedance at a node 16 at which the emitter of bipolar device Q3, the base of bipolar device Q2 and one end resistor R2 are coupled together.

The apparatus for generating a current linearly dependent on temperature, constructed in accordance with the present invention, also includes current combining means 14 coupled to proportional to absolute temperature current source 10 and constant current generation circuit 12 for combining the proportional to absolute temperature current $I_{PTAT}$ and the constant current independent of temperature $_{ICC}$ to generate a linearly temperature dependant current $I_T$ with a predetermined slope by reducing or increasing the proportional to absolute temperature current $I_{PTAT}$ by the constant current independent of temperature $I_{CC}$. In particular, for the embodiment of the invention illustrated by FIG. 3, current combining means 14 includes a first output device M5 to which the proportional to absolute temperature current $I_{PTAT}$ is conducted and a second output device Q6 to which the current independent of temperature $I_{CC}$ is conducted. The proportional to absolute temperature current $I_{PTAT}$ developed by proportional to absolute temperature current source 10 is conducted to first output device M5 of combining means 14.

CMOS device M3 of constant current generation circuit 12 acts in accord with CMOS device M4 of combining means 14 and bipolar devices Q4 and Q5 of combining means 14 as a current mirror to conduct the constant current independent of temperature $I_{CC}$ to second output device Q6 of combining means 14. For the embodiment of the invention being described, the first output device M5 is a semiconductor in the form of a CMOS device having a drain to which the proportional to absolute temperature current $I_{PTAT}$ is conducted and the second output device Q6 is a semiconductor in the form of a bipolar device having a collector to which the current independent of temperature $I_{CC}$ is conducted.

Current combining means 14 are arranged either to subtract the constant current independent of temperature $I_{CC}$ from the proportional to absolute temperature current $I_{PTAT}$ as illustrated or add the constant current independent of temperature $I_{CC}$ to the proportional to absolute temperature current $I_{PTAT}$. For the embodiment of the invention being described, first output device M5 and second output device Q6 are coupled together at a terminal or node 18 at which the proportional to absolute temperature current $I_{PTAT}$ and the constant current independent of temperature $I_{CC}$ are combined to generate the linearly temperature dependant current $I_T$ by reducing the proportional to absolute temperature current $I_{PTAT}$ by the constant current independent of temperature $I_{CC}$.

Instead of reducing the proportional to absolute temperature current $I_{PTAT}$ by the constant current independent of temperature $I_{CC}$, the proportional to absolute temperature current $I_{PTAT}$ can be increased by the constant current independent of temperature $I_{CC}$ by coupling together the drain of first output device M5 and th e drain of CMOS device M4 that serves, in this arrangement of combining means 14, as a second output device. When this is d one, bipolar devices Q4 and Q5 and second output device Q6 are not in the circuit.

Figure 4:
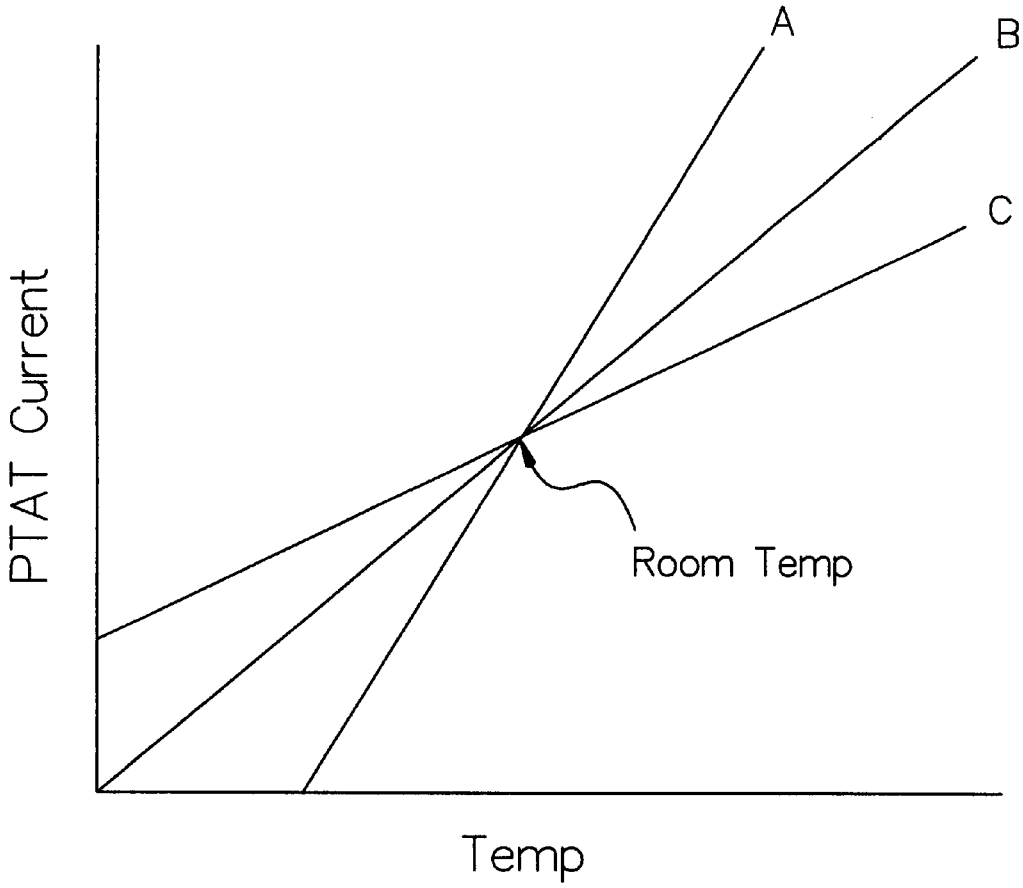
FIG. 4 depicts slopes of currents developed by the FIG. 3 current source.

The linearly temperature dependant current $I_T$ with a predetermined slope can be generated at different temperature-dependent slopes and is determined, for the embodiment of the invention illustrated by FIG. 3, by the mirror ratio between semiconductor devices M1 and M5 and between Q4 and Q6. The apparatus for generating a current linearly dependent on temperature, in one preferred form, is designed so that the value of the linearly temperature dependant current $I_T$ with a predetermined slope is equal to the proportional to absolute temperature current $I_{PTAT}$ at 27° C. The apparatus, according to this invention, provides a current value at room temperature with a slope other than the proportional to absolute temperature current. FIG. 4 depicts this desired relationship. The value of current sources represented by curves A and C are equal to the proportional to absolute temperature current source represented by curve B at room temperature, but have slopes other than the proportional to absolute temperature current. Thus, a temperature dependence, more steep or less steep than the proportional to absolute temperature current slope, is generated while maintaining a predetermined current at 27° C. Slope A of FIG. 4 corresponds to first output device M5 and second output device Q6 being coupled together, whereby the proportional to absolute temperature current $I_{PTAT}$ is reduced by the constant current independent of temperature $I_{CC}$, and slope C of FIG. 4 corresponds to first output device M5 device and M4, serving as the second output device, being coupled together, whereby the proportional to absolute temperature current $I_{PTAT}$ is increased by the constant current independent of temperature $I_{CC}$.

For example, it is desired to generate a linearly temperature dependant current $I_T$ of 100 $\mu$A at 27° C. on a slope equal to that of a proportional to absolute temperature current $I_{PTAT}$ having a value at 27° C. is 200 $\mu$A. To achieve this, devices are selected such that a proportional to absolute temperature current $I_{PTAT}$ of 100 $\mu$A at 27° C. flows through device Q1. Device M5 is set to have twice the aspect ratio of device Q1, so that when the proportional to absolute temperature current $I_{PTAT}$ is combined with the constant current independent of temperature $I_{CC}$, the linearly temperature dependent current $I_T$ is equal to 100 $\mu$A. To generate the constant current independent of temperature $I_{CC}$ of 100 $\mu$A, the value of resistor R2 is selected such that when a bandgap voltage is divided by the value of R2, 100 $\mu$A (R2=11.96 k) is developed. The constant current independent of temperature $I_{CC}$ is then mirrored with a ratio of one in device Q6 which implies that the area of Q4 is identical to the area of Q6 and the area of M3 is identical to the area of M5. Subsequently, the linearly temperature dependant current $I_T$ has a steeper temperature dependence than the proportional to absolute temperature current $I_{PTAT}$ of 100 $\mu$A at 27° C. and also the linearly temperature dependant current $I_T$ is equal to the proportional to absolute temperature current $I_{PTAT}$ of 100 $\mu$A at 27° C. Accordingly, the above example is meant to be exemplary and by no means should be taken to limit the scope of the present invention.

Although described and illustrated above with reference to certain specific embodiments, the present invention is nevertheless not intended to be limited to the details shown. Rather, various modifications may be made in the details within the scope and range of equivalents of the claims and without departing from the spirit of the invention.

What is claimed:

1. An apparatus for generating a current linearly dependent on temperature comprising:

a proportional to absolute temperature current source for generating a proportional to absolute temperature current;

a constant current generation circuit responsive to said proportional to absolute temperature current for generating a constant current independent of temperature; and current combining means coupled to said proportional to absolute temperature current source and said constant current generation circuit for combining said proportional to absolute temperature current and said constant current independent of temperature to generate a linearly temperature dependant current with a predetermined slope by one of:

(a) reducing said proportional to absolute temperature current by said constant current independent of temperature, and (b) increasing said proportional to absolute temperature current by said constant current independent of temperature.

2. The apparatus according to claim 1 wherein said current combining means include:

(a) a first output device to which said proportional to absolute temperature current is conducted, (b) a second output device to which said current independent of temperature is conducted, and (c) means for coupling together said first output device and said second output device.

3. The apparatus according to claim 2 wherein:

(a) said first output device is a semiconductor device having a drain to which said proportional to absolute temperature current is conducted, and (b) said second output device is a semiconductor device having a collector to which said current in dependent of temperature is conducted.

4. The apparatus according to claim 3 wherein:

(a) said first output device is a CMOS device, and (b) said second output device is a bipolar device.

5. The apparatus according to claim 2 wherein:

(a) said first output device is a semiconductor device having a drain to which said proportional to absolute temperature current is conducted, and (b) said second output device is a semiconductor device having a d rain to which said current independent of temperature is conducted.

6. The apparatus according to claim 5 wherein:

(a) said first output device is a CMOS device, and (b) said second output device is a CMOS device.

7. A method for generating a current linearly dependent on temperature comprising the steps of:

generating a proportional to absolute temperature current;

generating a constant current independent of temperature in response to said proportional to absolute temperature current; and combining said proportional to absolute temperature current and said constant current independent of temperature to generate a linearly temperature dependant current with a predetermined slope and by at least one of reducing said proportional to absolute temperature current by said current independent of temperature and increasing the proportional to absolute temperature current by the constant current independent of temperature.

8. The method of claim 7 wherein said proportional to absolute temperature current and said constant current independent of temperature are combined to generate a linearly temperature dependant current with a predetermined slope by reducing said proportional to absolute temperature current by said current independent of temperature.

9. The method of claim 7 wherein said proportional to absolute temperature current and said constant current independent of temperature are combined to generate a linearly temperature dependant current with a predetermined slope by increasing said proportional to absolute temperature current by said current independent of temperature.

10. The method of claim 7 wherein said predetermined slope is equal to the proportional to absolute temperature current at 27° C.

11. The apparatus of claim 4 wherein said predetermined slope is equal to the proportional to absolute temperature current at 27° C.

12. The apparatus of claim 6 wherein said predetermined slope is equal to the proportional to absolute temperature current at 27° C.

* * * * *